US006127666A

United States Patent [19]

Sohn

[11] Patent Number: 6,127,666

[45] Date of Patent: Oct. 3, 2000

[54] COOLING DEVICE FOR HALOGEN LAMP IN MICROWAVE OVENS

[75] Inventor: Hwi-Chang Sohn, Changwon Gyeongnam, Rep. of Korea

[73] Assignee: LG Electronics, Inc., Seoul, Rep. of Korea

[21] Appl. No.: 09/362,894

[22] Filed: Jul. 29, 1999

[30] Foreign Application Priority Data

Jul. 29, 1998 [KR] Rep. of Korea ..... 98-14105

[51] Int. Cl.[7] ..... H05B 6/80

[52] U.S. Cl. ..... 219/757; 219/707; 315/112

[58] Field of Search ..... 219/757, 758, 219/685, 756, 707, 710; 315/112, 114, 115

[56] References Cited

U.S. PATENT DOCUMENTS 5,445,009 8/1995 Yang et al. ..... 219/707
5,666,640 9/1997 Daniylchev ..... 432/186.1
5,951,907 9/1999 Kang ..... 219/757
6,005,235 12/1999 Shin ..... 219/757

*Primary Examiner*—David Vu
*Assistant Examiner*—Wilson Lee
*Attorney, Agent, or Firm*—Fleshner & Kim, LLP

[57] ABSTRACT

A cooling device for halogen lamps in microwave ovens is disclosed. In the cooling device, two halogen lamps, installed on the top wall of the cavity, radiate light waves into a cavity. A cooling fan assembly, provided at a position around the halogen lamps, generates a cooling air current for the lamps. An air guide duct guides the cooling air current so as to allow the air current to flow from the cooling fan assembly into the atmosphere while cooling the lamps. An exhaust fan is provided within the air outlet port of the air guide duct. The exhaust fan increases the flowing rate of the air current at the air outlet port, which is bent at a right angle. Due to the exhaust fan, the cooling device of this invention more effectively cools the halogen lamps and allows the cooling air current to be more smoothly discharged from the duct into the atmosphere regardless of the bent shape of the air outlet port.

12 Claims, 5 Drawing Sheets

COOLING DEVICE FOR HALOGEN LAMP IN MICROWAVE OVENS

BACKGROUND OF THE INVENTION

1. Field of the Invention

The present invention relates, in general, to a cooling device for halogen lamps in microwave ovens and, more particularly, to a cooling device designed to more effectively cool the halogen lamps in microwave ovens by installing an exhaust fan at a position around the air outlet part of an air passage behind the halogen lamps.

2. Description of the Prior Art

As well known to those skilled in the art, several types of electric cooking devices, designed to directly or indirectly utilize electric power while cooking, have been proposed and used. An example of conventional electric cooking devices is a microwave oven using a magnetron as a heat source. In such a microwave oven, the magnetron is electrically operated to generate microwaves and applies the microwaves to food in a cavity, thus allowing the microwaves to cause an active molecular motion in the food. Such an active molecular motion in the food generates molecular kinetic energy, thus heating and cooking the food. Such microwave ovens are advantageous in that they have a simple construction and are convenient to a user while cooking, and easily and simply heat food in the cavity. The microwave ovens are thus somewhat preferably used for some cooking applications, such as a thawing operation for frozen food or a heating operation for milk requiring to be heated to a desired temperature.

However, such microwave ovens also have the following problems. That is, the ovens have a defect in their heating style in addition to limited output power of the magnetron, and so it is almost impossible to freely or preferably use them for a variety of cooking applications, without limitation. In a detailed description, the conventional microwave ovens only utilize a magnetron as a heat source, thus undesirably having a single heating style. In addition, the output power of the magnetron, installed in such ovens, is limited to a predetermined level. Therefore, the conventional microwave ovens fail to provide a quick and highly effective cooking operation. During a cooking operation utilizing such a microwave oven, food in a cavity is heated at its internal and external portions at the same time, and this may be an advantage of the oven in some cases. However, such a heating style may result in a disadvantage while cooking some food.

In an effort to overcome the above-mentioned problems, several types of microwave ovens, having another heat source in addition to a magnetron, have been proposed and used. For example, a microwave oven, having a convection heater in addition to a magnetron in a casing and originally designed to be used for a variety of cooking applications, has been proposed. However, such a convection heater only acts as a single heat source, thus failing to allow the microwave oven to have a variety of operational functions.

In order to solve the problems of the conventional microwave ovens, another type of microwave oven, utilizing a light wave, has been proposed. In this microwave oven, a lamp, wherein at least 90% of the radiation energy has a wavelength of not longer than 1 $\mu$m, is used as the additional heat source. In said microwave oven, both visible rays and infrared rays from the lamp are appropriately used, and it is possible to preferably heat the exterior and interior of food while making the most of characteristics of the food. An example of such a lamp is a halogen lamp.

Due to a difference in wavelengths between the infrared rays and visible rays emanating from a halogen lamp, the heating styles for the exterior and interior of food are different from each other. While cooking pizza utilizing a halogen lamp, it is possible to appropriately heat the pizza in a way such that the exterior of the pizza is heated to become crisp and the interior is heated to be soft while maintaining appropriate moisture.

FIG. 1 is a conventional microwave oven utilizing a halogen lamp as an additional heat source. As shown in the drawing, the microwave oven comprises two halogen lamps 12 and 14 installed on the top wall 10 of a cavity 2. The microwave oven uses the light waves, radiated from the lamps 12 and 14, for heating food in the same manner as that described above, with the characteristics of the light waves remaining the same as that described above.

A light reflection plate 16 is installed at a position above the halogen lamps 12 and 14, thus reflecting any light waves, emanating upwardly from the lamps 12 and 14, back downwardly into the cavity 2. A plurality of light transmitting holes 18 are formed on the top wall 10 of the cavity 2, with the halogen lamps 12 and 14 being held on the top wall.

The halogen lamps 12 and 14 generate a large amount of light waves during an operation of the microwave oven, and so the lamps 12 and 14 are heated to a high temperature and may be undesirably overheated. Therefore, it is necessary to completely cool the halogen lamps 12 and 14. In order to accomplish the above object, the microwave oven is provided with a cooling device as shown in FIG. 2.

As shown in the drawing, the typical cooling device comprises a cooling fan unit 20 provided at a position around the lamps 12 and 14. In the cooling device, the cooling air current, generated from the cooling fan unit 20, passes through an air guide duct 22 while flowing along the halogen lamps 12 and 14 prior to being discharged from the duct 22 into the atmosphere as shown by the arrows in FIG. 2.

The above guide duct 22 has the following structure. That is, the guide duct 22 extends in the same direction as the axis of the lamps 12 and 14. The duct 22 is, thereafter, bent at an angle of 90° at a position around the left-side end of the lamps 12 and 14 in FIG. 2. The outlet end of the duct is thus open to the front of the microwave oven. Due to such a structure of the duct 22, the cooling air current, emanating from the fan unit 20, flows along the lamps 12 and 14 while cooling them. The air current is, thereafter, discharged from the duct 22 into the atmosphere through the outlet end of the duct 22.

However, the above cooling device is problematic as follows. That is, the duct 22 is bent at an angle of 90° at the position around the left-side end of the lamps 12 and 14 in FIG. 2 as described above. Therefore, the duct 22 forms a vortex of the air current at its bent portion and causes an excessive energy loss of the air current at that portion. This prevents the air current from being smoothly discharged from the duct into the atmosphere.

SUMMARY OF THE INVENTION

Accordingly, the present invention has been made keeping in mind the above problems occurring in the prior art, and an object of the present invention is to provide a cooling device for halogen lamps in microwave ovens, which is designed to more effectively cool the halogen lamps.

In order to accomplish the above object, the present invention provides a cooling device for light radiating lamps in microwave ovens, comprising: a light radiating lamp installed on a top wall of a cavity of a microwave oven and used for radiating light waves into the cavity; a cooling fan assembly provided at a position around the light radiating lamp and used for generating a cooling air current for the light radiating lamp; an air passage guiding the cooling air current so as to allow the air current to flow from the cooling fan assembly into the atmosphere while cooling the light radiating lamp; and an exhaust fan provided within an air outlet port of the air passage and used for increasing a flowing rate of the air current at the air outlet port.

In the above microwave oven, the cooling air current, emanating from the cooling fan unit, is partially introduced into both a machine room and the cavity of the microwave oven, with both a magnetron and a high voltage transformer being installed within the machine room.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
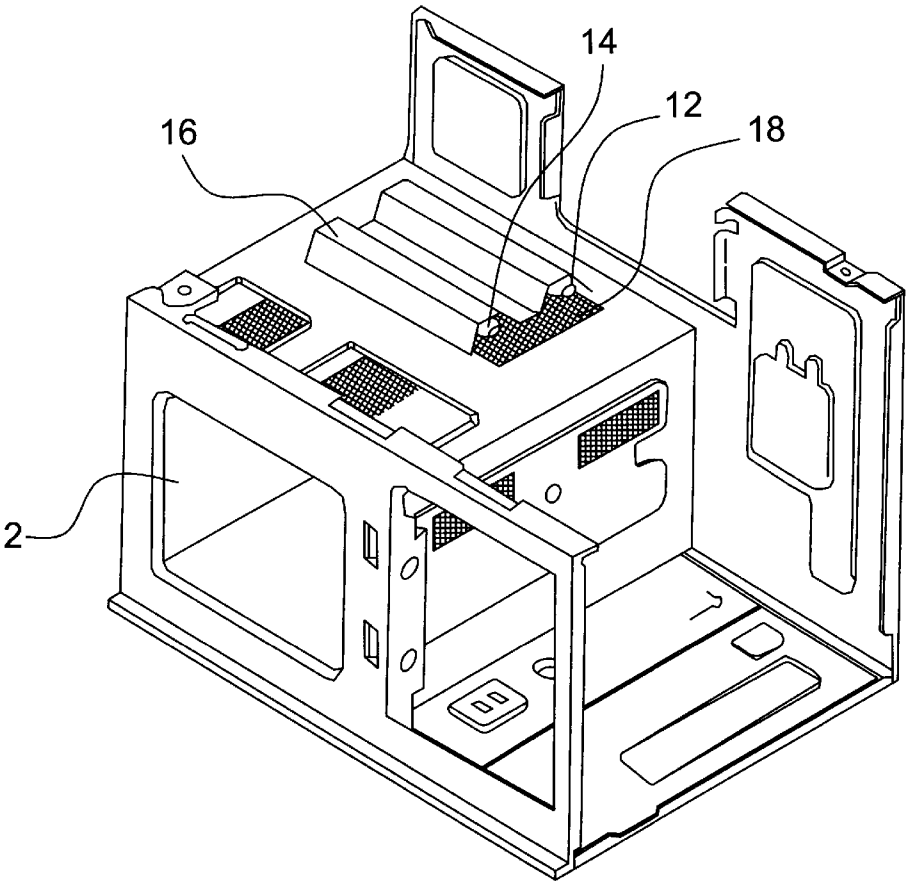
FIG. 1 BACKGROUND ART
FIG. 1 is a perspective view, showing the construction of a conventional microwave oven utilizing halogen lamps as a heat source.
Figure 2:
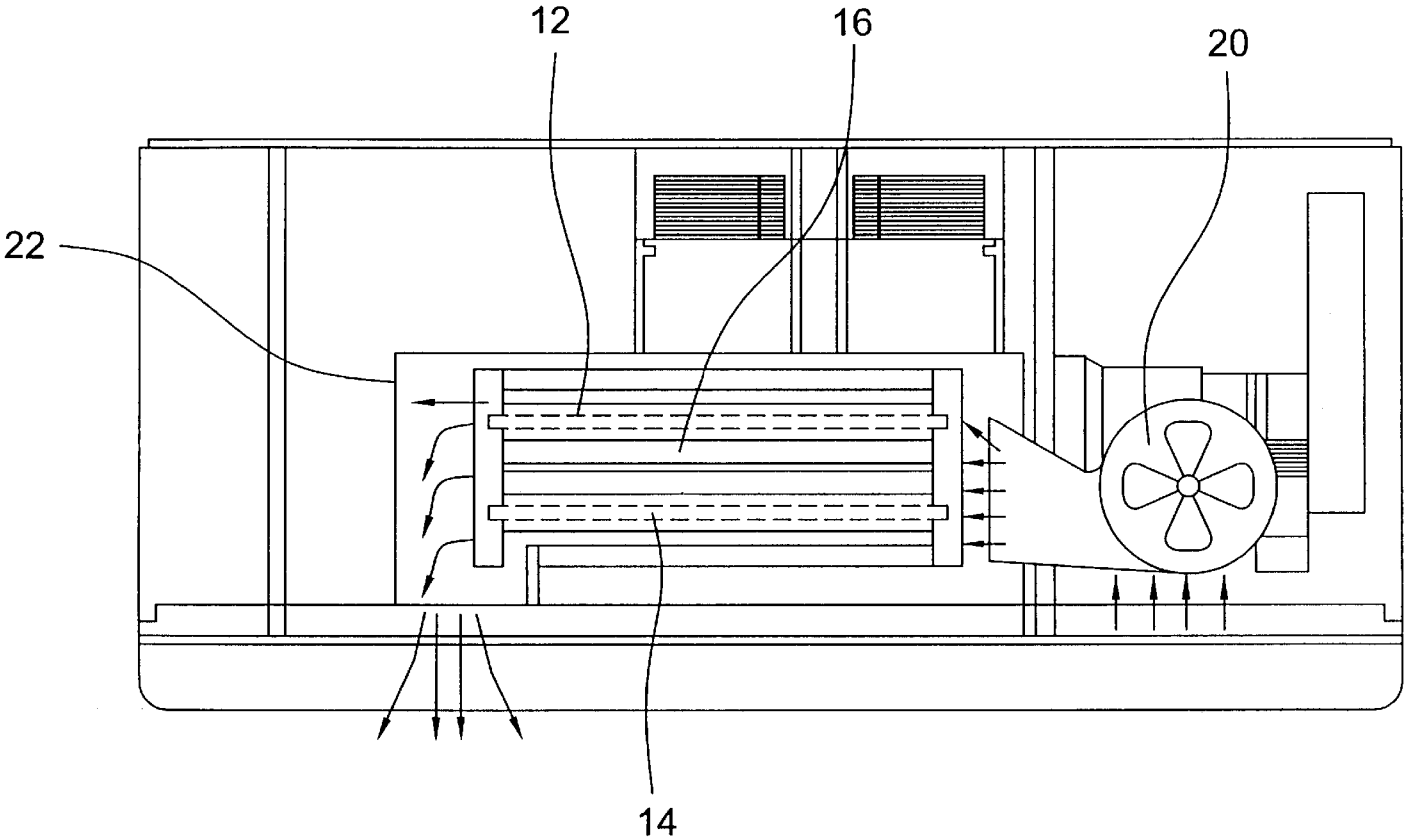
FIG. 2 BACKGROUND ART
FIG. 2 is a plan view, showing the construction of a typical cooling device for the halogen lamps of a microwave oven.
Figure 3:
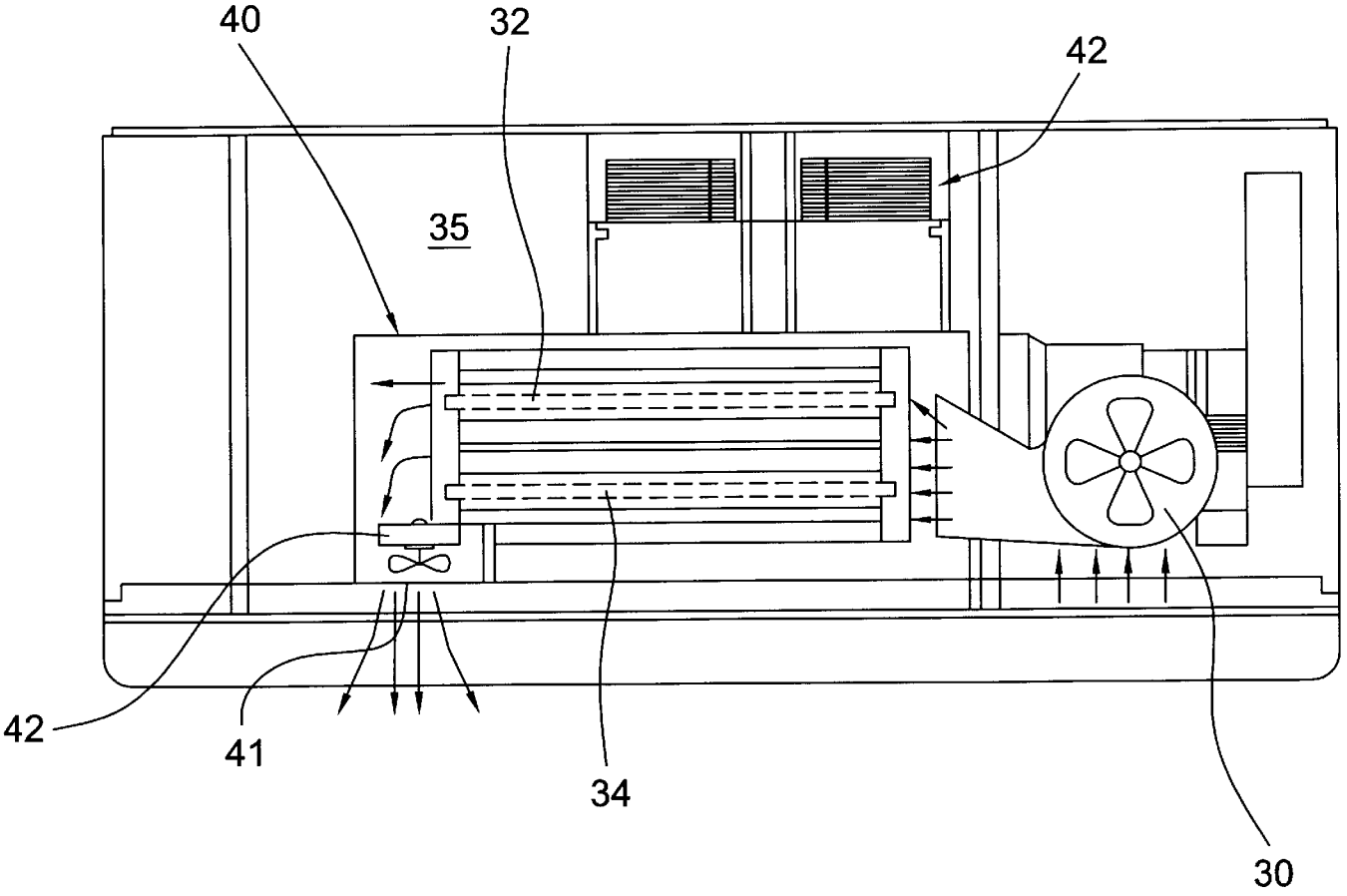
FIG. 3 is a plan view, showing the construction of a cooling device for the halogen lamps of a microwave oven in accordance with the preferred embodiment of the present invention.
Figure 4:
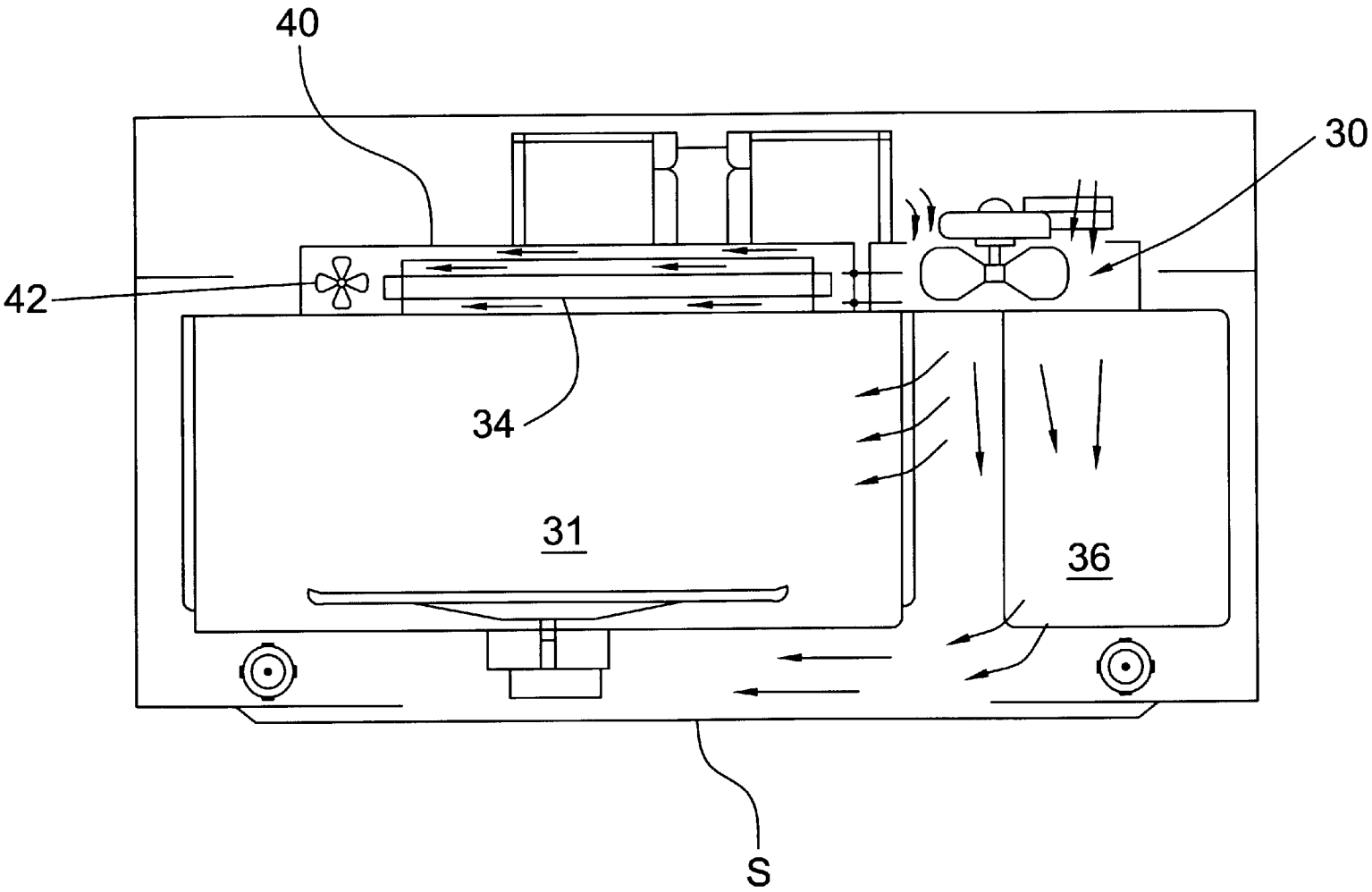
FIG. 4 is a front view, showing the construction of the cooling device of this invention.
Figure 5:
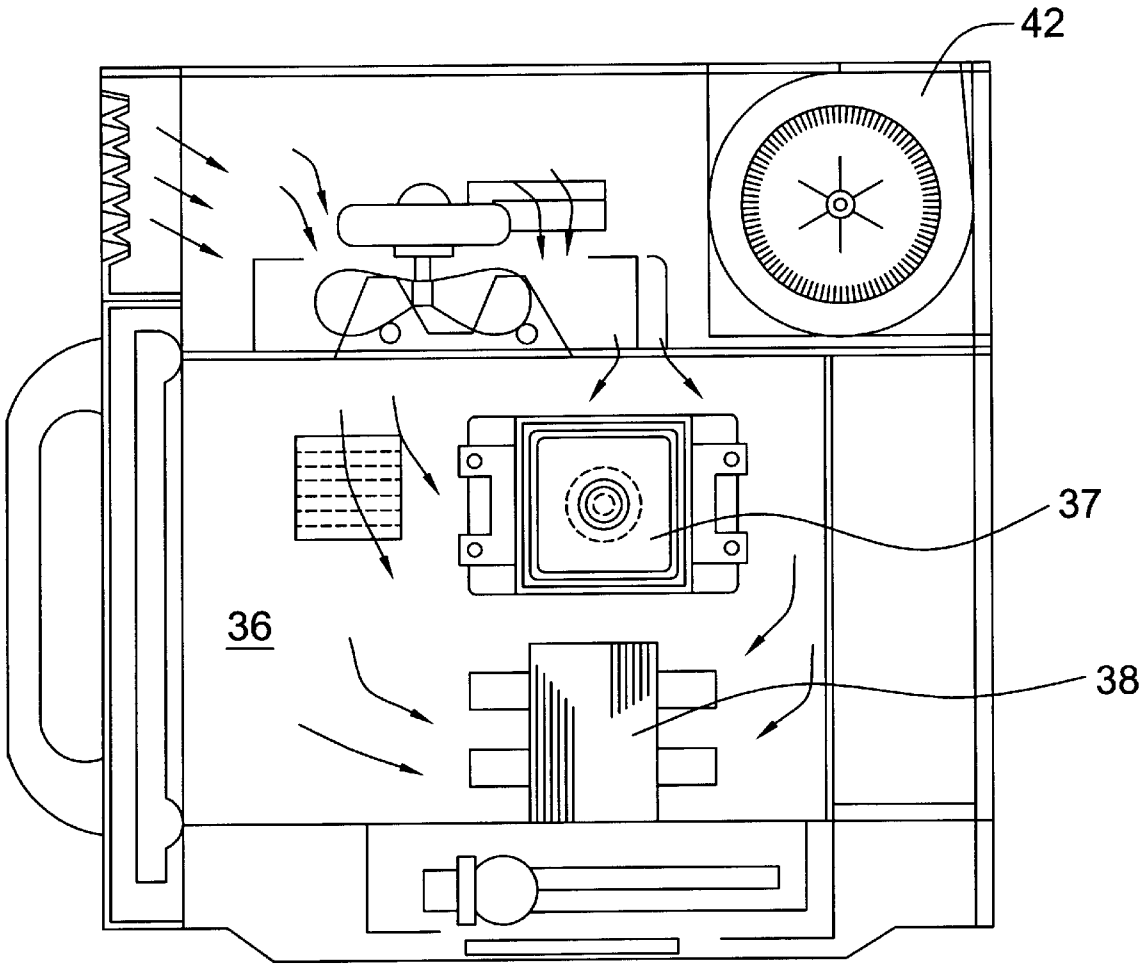
FIG. 5 is a side view, showing the construction of the cooling device of this invention.

FIG. 3 is a plan view, showing the construction of a cooling device for the halogen lamps in microwave ovens in accordance with the preferred embodiment of this invention. As shown in the drawing, the cooling device of this invention comprises a cooling fan assembly 30 used for cooling two halogen lamps 32 and 34 provided on the top wall 35 of a cavity. The assembly 30, provided with a fan, is positioned on the right side of the microwave oven in the drawing. As best seen in FIGS. 4 and 5, the cooling fan assembly 30 is practically positioned above the machine room 36 wherein both a magnetron 37 and a high voltage transformer 38 are positioned. In such a case, the magnetron 37 is used for generating microwaves, while the transformer 38 is used for applying a high voltage to the magnetron 37.

The cooling air current, generated from the assembly 30, passes through an air guide duct 40 while flowing along the halogen lamps 32 and 34. The air current thus cools the lamps 32 and 34. In accordance with the present invention, an additional fan 42 is provided within the air outlet port 41 of the duct 40.

The additional fan 42, provided within the air outlet port 41 of the duct 40, acts as an exhaust fan. The fan 42 thus more smoothly discharges the air current from the duct 40 into the atmosphere through the air outlet port 41. That is, the exhaust fan 42 increases the flowing rate of the air current passing through the air outlet port 41 of the duct 40, thus allowing the air current to be more smoothly discharged from the duct 40 into the atmosphere. The exhaust fan 42 also improves the lamp cooling effect of the air current.

FIGS. 4 and 5 are front and side views, showing the construction of the cooling device of this invention. As shown in FIG. 4, the cooling air current, generated from the fan assembly 30, flows through the duct 40 while cooling the halogen lamps 32 and 34. The flowing rate of the air current is increased by the exhaust fan 42, provided within the air outlet port 41 of the duct. The air current is thus more smoothly discharged from the duct 40 into the atmosphere through the a ir outlet port 41.

In a detailed description, the air current, emanating from the cooling fan assembly 30, is partially introduced into the machine room 36. Within the machine room 36, the air current is partially introduced into the cavity 31. On the other hand, the remaining air current, introduced into the machine room 36, cools both the magnetron 37 and the high voltage transformer 38 prior to being discharged from the room 36 into the atmosphere through the gap formed between the cavity 31 and an external casing S. The air current, introduced into the cavity 31, is discharged from the cavity 31 into the atmosphere through an exhaust port provided on the sidewall of the cavity 31. In FIG. 5, the reference numeral 42' denotes an exhaust motor, which is used for activating an air exhausting operation of an OTR-type microwave oven.

As described above, the present invention provides a cooling device for halogen lamps in microwave ovens. The cooling device of this invention comprises a cooling fan assembly 30. The fan assembly 30, provided at a position around the halogen lamps 32 and 34, generates a cooling air current. The air current, emanating from the fan assembly 30, passes through an air guide duct while cooling the lamps positioned within the duct. An exhaust fan 42 is provided within the air outlet port of the duct, thus increasing the flowing rate of the air current at the air outlet port, or a bent portion. The exhaust fan 42 thus allows the air current to be more smoothly discharged from the duct into the atmosphere.

That is, the cooling device of this invention is provided with a fan at each end of a cooling air passage. Due to the two fans provided at both ends of the cooling air passage, the flowing rate of the air current is increased. The cooling device of this invention thus more effectively cools the halogen lamps and allows the cooling air current to be more smoothly discharged from the duct into the atmosphere irrespective of the bent shape of the air outlet port of the duct. Therefore, the cooling device allows the halogen lamps to normally perform their designed operational function for a lengthy period of time. This improves the operational reliability and market competitiveness of the microwave ovens.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A cooling device for a microwave oven having a light radiating lamp installed adjacent a cooking cavity of the microwave oven, comprising:

a cooling fan assembly provided at a position around the light radiating lamp and used for generating a cooling air current for cooling said light radiating lamp;

an air passage guiding the cooling air current so as to allow the cooling air current to flow from the cooling fan assembly into the atmosphere while cooling the light radiating lamp; and an exhaust fan provided within an air outlet port of said air passage and used for increasing a flow rate of the cooling air current at the air outlet port.

2. The cooling device according to claim 1, wherein a portion of said cooling air current, emanating from the cooling fan assembly, is partially introduced into both a machine room and the cooking cavity of the microwave oven, and wherein a magnetron and a high voltage transformer are installed within the machine room.

3. The cooling device according to claim 1, wherein a portion of the cooling air current is directed into a machine room of the microwave oven.

4. The cooling device according to claim 3, wherein electronic components of the microwave oven responsible for generating microwaves are mounted in the machine room.

5. The cooling device according to claim 1, wherein a portion of the cooling air current is directed to the cooking cavity of the microwave oven.

6. The cooling device according to claim 1, wherein a first portion of the cooling air current is directed into the air passage, wherein a second portion of the cooling air current is directed into a machine room of the microwave oven that contains a magnetron, and wherein a third portion of the cooling air current is directed into the cooking cavity.

7. A cooling system for a microwave oven that includes a light radiating lamp installed adjacent to a cooking cavity, and a machine room that houses electrical components used to generate microwaves, the cooling system comprising:

a cooling fan that generates a cooling air current;

an air duct that guides at least a first portion of the cooling air current past the light radiating lamp and to an outlet port; and an exhaust fan located adjacent the outlet port, wherein the exhaust fan helps to expel the first portion of the cooling air current out the outlet port.

8. The cooling system of claim 7, wherein the cooling system is configured such that a second portion of the cooling air current passes into the machine room of the microwave oven.

9. The cooling system of claim 8, wherein the cooling system is configured such that a third portion of the cooling air current passes into the cooking cavity.

10. The cooling system of claim 7, wherein the cooling system is configured such that a second portion of the cooling air current passes into the cooking cavity.

11. The cooling system of claim 7, wherein the cooling system is configured such that a portion of the cooling air current passes from the cooling fan, into the machine room, and then into the cooking cavity.

12. A cooling device for a microwave oven having a light radiating lamp adjacent a cooking cavity of the oven, comprising:

a cooling fan assembly provided adjacent the light radiating lamp, wherein the cooling fan assembly generates a cooling air current for cooling the light radiating lamp;

an air passage guiding the cooling air current so as to allow the cooling air current to flow from the cooling fan assembly into the atmosphere while cooling the light radiating lamp; and an exhaust fan positioned within an air outlet port of the air passage and used for increasing a flow rate of the cooling air current at the air outlet port.

* * * * *